United States Patent [19]

Borg

[11] 4,114,969

[45] Sep. 19, 1978

[54] PLUG RELEASE MECHANISM

[76] Inventor: John P. Borg, 10 Poplar Heights Dr., Islington, Ontario, Canada

[21] Appl. No.: 837,924

[22] Filed: Sep. 29, 1977

[51] Int. Cl.[2] ..... H01R 13/62

[52] U.S. Cl. ..... 339/45 R

[58] Field of Search ..... 339/34, 35, 45 R, 45 M, 339/45 T, 46

[56] References Cited

U.S. PATENT DOCUMENTS

| | | | |
|---|---|---|---|
| 2,955,273 | 10/1960 | Winkler | 339/45 M |
| 4,045,106 | 8/1977 | Borg | 339/45 R |

*Primary Examiner*—Neil Abrams

*Attorney, Agent, or Firm*—George H. Riches

[57] ABSTRACT

A plug release mechanism consisting of a spring mounted reciprocatable member to which is attached an electrical plug. The reciprocatable member carries an inner tubular member coaxially therewith, a stationary member between the inner member and the reciprocatable member, a spring acting between the reciprocatable member and the stationary member and a lever mounted on an extension projecting outwardly from the stationary member through the reciprocatable member. An electrical cord is introduced through a sleeve pivotally mounted between the outer ends of the lever, down through the stationary member and connected to the electrical plug in the usual manner. When the cord is aligned with the lever, a tug on the cord will disconnect the plug from the outlet. When the cord is at an angle to the plug, the sleeve will be at a similar angle so that a pull on the cord causes the lever to rotate and disengage from the locked position with the reciprocatable member whereupon the spring activates the reciprocatable member to withdraw the plug from the outlet.

5 Claims, 5 Drawing Figures

PLUG RELEASE MECHANISM

BACKGROUND OF THE INVENTION

My prior application which is now U.S. Pat. No. 4,045,106 dated Aug. 30, 1977 describes an automatic electric plug release which automatically, by a slight pull on the electrical cord, withdraws the plug and its terminal prongs from the electric wall socket into which its terminal prongs have been inserted. The automatic plug release of the said patent consists essentially of:

(i) a receptacle having a hollow cylindrically shaped base portion with a substantially wide opening therethrough, said base portion being seatable against the outer wall plate of an electric wall outlet, and a cylindrically shaped top portion having at least two equally spaced lugs projecting inwardly, from opposed positions on the inside wall thereof;

(ii) an inverted cup shaped mounting member mounted in the receptacle for rotative and up-and-down movement between a locked position and an unlocked position;

(iii) an electrical plug mounted in the mounting member for rotative movement thereon and up-and-down movement therewith;

(iv) a coiled compression spring mounted in the mounting member between said mounting member and said base portion, said spring surrounding said electrical plug;

(v) complemental ears on the mounting member engageable with said lugs when the mounting member is depressed and rotated in one direction whereby the mounting member and electrical plug are held in the locked position with the terminal prongs extending outwardly from the base; and (vi) an electrical cord sleeve for an electric cord mounted on the top of the electric plug and extending through the top portion whereby on pulling on the electrical cord, the mounting member is rotated and released from the locked position and moved upwardly to the unlocked position, thereby withdrawing the prongs from the socket.

DESCRIPTION OF THE INVENTION

The drawings illustrate two embodiments of the invention in which.

Figure 1:
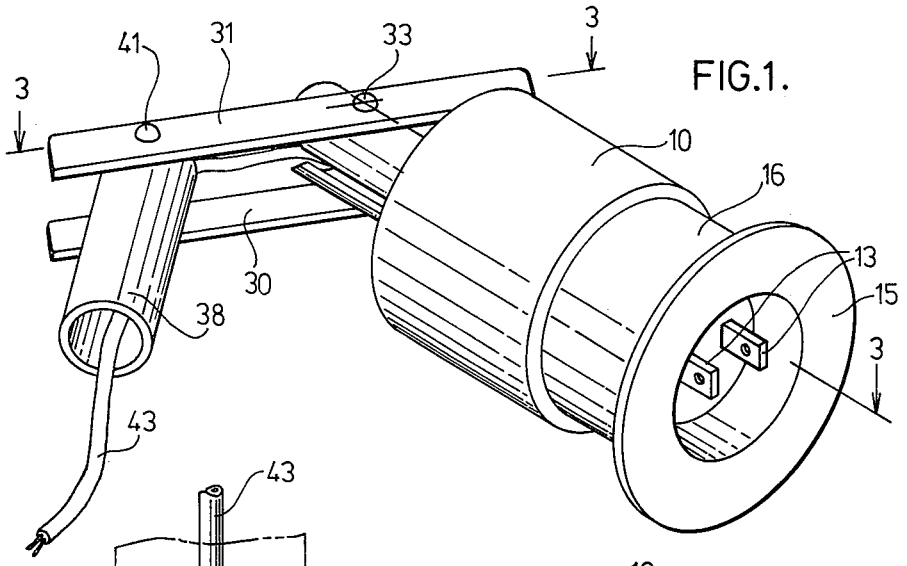
FIG. 1 is an assembled perspective view of the electric plug release mechanism in the released position.

The electric plug release mechanism comprises a hollow reciprocatable cylindrical member 10 having an inner tubular member 11 coaxial therewith. On the bottom end of the tubular member is mounted an electrical plug 12 with terminals 13 and a stationary member 14 also coaxial with the inner tubular member 11. In the embodiment shown in FIGS. 1, 2, 3 and 4, the stationary member consists of a flange 15, a cylindrical base portion 16, a shoulder 17 and a pair of arms 18, 19 which are spaced apart to form slots 21, 21*a* therebetween. Coiled around the arms 18, 19 is a compression spring 22 which is supported by the shoulder 17. The arms 18, 19 are each formed with holes 23, 24 adjacent the top ends thereof, the holes being being provided for the purpose hereinafter described.

The reciprocatable member 10 has its top end surface 25 formed with a pair of slots 26, 27 through which the arms 18, 19 project when the plug release mechanism is assembled. In the illustrated embodiment, the arms 18, 19 are arcuately shaped in cross section and the slots 25, 26 are correspondingly shaped to receive the arms 18, 19. The portions 28, 29 ride in the slots 21, 21*a* formed between the arms 18, 19.

The means by which the locking lever mechanism is locked in the locked position comprises a pair of bars 30, 31 which are pivotally connected to the upper ends of the arms 18, 19 by pivot screws 32, 33 which are entered through holes 34, 35 and the bars 30, 31 and threaded into the holes 23, 24. The pivot screws 32, 33 serve as the fulcrum of the bars 30, 31. The end portions of each bar are indicated by the numerals 36, 37 and it will be noted that the ends are slightly curved at the junction between the ends and the sides of the bars. The end portions of each bar from their fulcrum to the ends 36, 37 are of a length to engage against the top portion 25 of the reciprocatable member 10 and depress the member 10 when the lever is coaxial with the members 10, 14 in the assembled position. This position is referred to as the locked position. In this position the spring 20 is compressed and the terminals 13, 13 of the electrical plug 12 are located below the flange 15 as clearly shown in FIG. 4, in which position the terminals can be inserted in the electrical outlet 44. A sleeve 38 is pivotally mounted by means of screws 41, only one of which is shown, on the arms between the fulcrum and the end of the lever opposite the ends 36, 37. The electric cord 39 is threaded through the sleeve 38, between the arms 18, 19, member 14 and attached to the terminals 13, 13 of the plug 12 which is then firmly secured at the lower open end of member 11 as clearly shown in FIG. 4.

Figure 5:
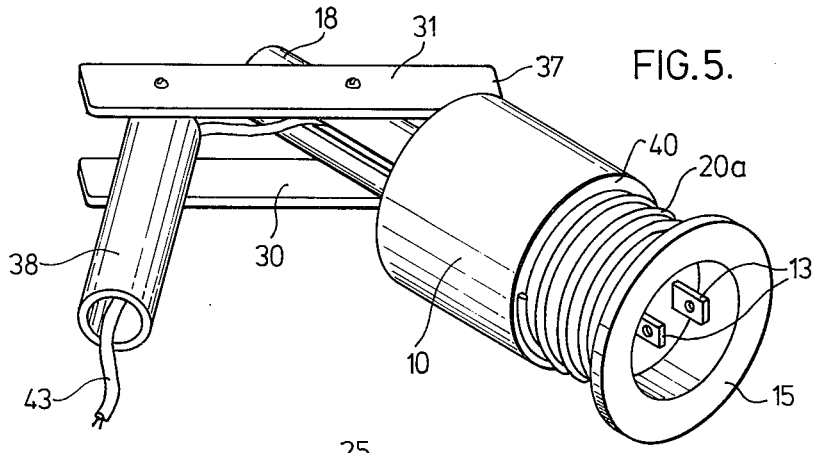
FIG. 5 is a perspective view of an alternative construction and is shown on the same sheet with FIG. 2.

Referring now to the structure illustrated in FIG. 5, the only difference between this illustrated embodiment and the one shown in the other views resides in the location of the compression spring 20. In FIG. 5, the compression spring 20A is on the exterior of the release mechanism and is mounted around the cylindrical base 16 and is engaged between the flange 15 and the rim 40 of the member 10.

Figure 4:
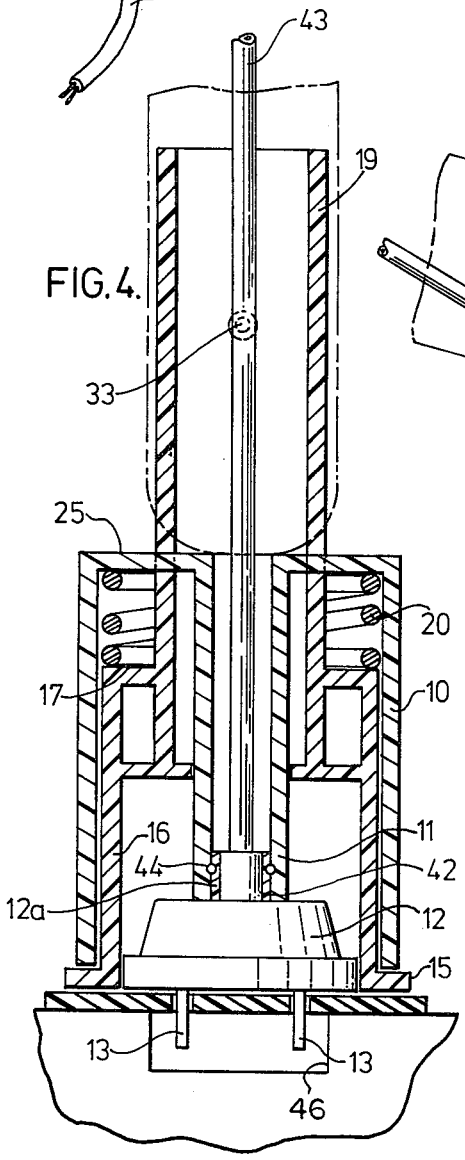
FIG. 4 is a cross section similar to FIG. 3 but with the plug release mechanism in the locked position.
Figure 3:
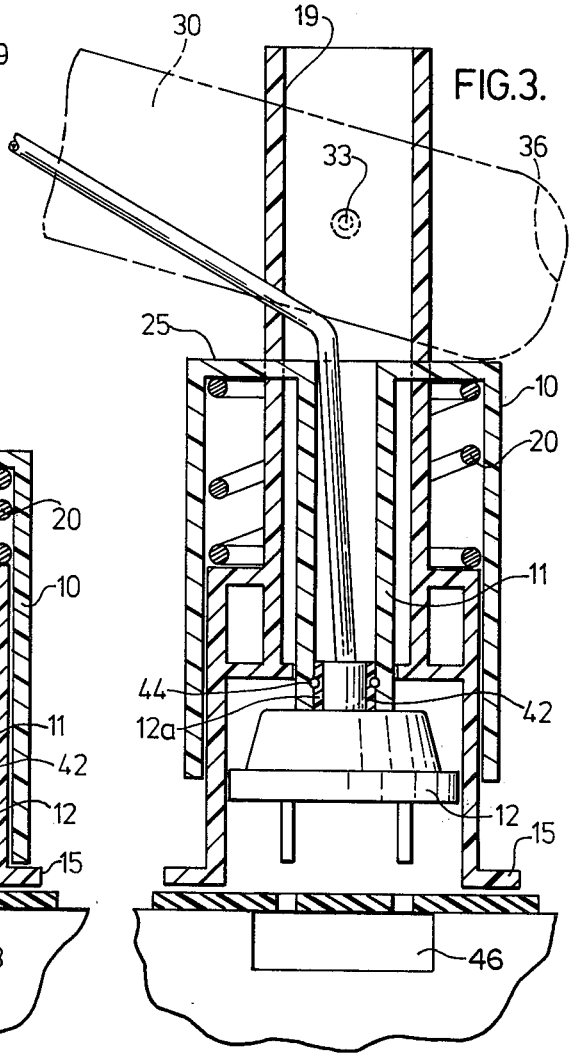
FIG. 3 is a cross section on the lines 3—3 of FIG. 1 in the release position.
Figure 2:
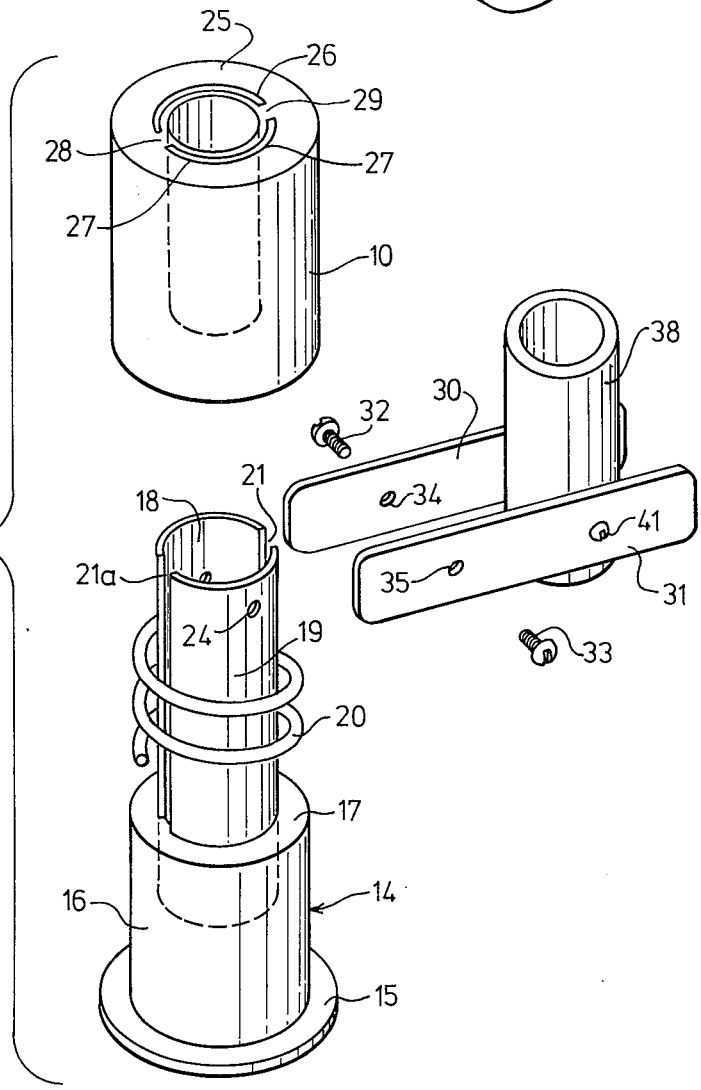
FIG. 2 is an exploded perspective view to show the several parts of the plug release mechanism.

The assembly of the release mechanism is as follows. The compression spring 20 is mounted in place as shown in FIG. 2 or 5 of the drawings. The arms 18, 19 are pushed up through the slots 21, 21*a* which places the base inside the member 10 with the spring 22 inside the reciprocatable member 10 as shown in FIGS. 3 and 4 or with the spring 20A with the spring outside the base 16 as shown in FIG. 5. The bars 30, 31 are then attached to arms 18, 19 by the pivot screws 32, 33. The electric cord 43 is then threaded through member 11 between arms 18, 19 and sleeve 38. The electric plug is then attached in its appropriate position and secured in the mouth 42 of the tubular member 11 with the terminals projecting outwardly as shown clearly in the drawings. On referring to FIGS. 3 and 4 it will be seen that the lower end of the tubular member 11 adjacent the mouth 42 and the neck 12*a* of the plug 12 are each provided with an annular groove in registration with each other. An annular ring 44 fits into the grooves and fastens the plug 12 in the mouth 42 with sufficient holding power to ensure that when the reciprocatable member 10 is released from the locked position the plug 12 will move with the member 10. It will be seen that this mounting permits the member 10 to rotate fairly freely relative to the plug 12. Other means may be provided which will permit relative rotative movement of the locking lever mechanism to align the mechanism and the cord.

FIG. 3 shows the plug retracted up into the stationary member 14 which is the released position. To place the plug 12 in its operative position in which position the terminals will be located outside the rim 15, the arms 30, 31 are moved on their pivots so that they are coaxial with the members 10, 14. This movement actuates the member 10 in a direction to compress the spring 20 and move the terminals 13 to a position (the operative position) outside the flange 15. This is the locked position. In this position the terminals can be inserted in the electrical outlet 46. When the release mechanism is in the locked position (FIG. 4) the cord, sleeve and bars are coaxial with the plug 12. In this position the plug can be separated from the outlet 46 by simply pulling on the cord. When the cord and sleeve are out of alignment (at an angle to the bars), a substantial pull on the cord will first cause the member 10 to rotate to a position in which the cord and sleeve are aligned and a continued pull on the cord will cause the bars 30, 31 to pivot on their fulcrum and cause the ends 36, 37 to disengage from the top portion 35 of member 10 (see FIGS. 1 and 5). When so disengaged, the compression spring 20 forces the member 10 away from the flange 15 and simultaneously withdraws the terminals 13 of the electrical plug 12 from the electric outlet 46.

Although the disclosure describes and illustrates a preferred embodiment of the invention, it is to be understood the invention is not restricted to this particular embodiment.

LIST OF PARTS AND REFERENCE NUMBERS

| | | | | | |
|---|---|---|---|---|---|
| 10 | - | hollow reciprocatable member | 38 | - | sleeve |
| | | | 39 | - | cord |
| 11 | - | inner tubular member | 40 | - | rim |
| 12 | - | electrical plug | 41 | - | screws |
| 13 | - | terminals | 42 | - | mouth |
| 14 | - | stationary member | 43 | - | cord |
| 15 | - | flange on stationary member | 12a | - | neck |
| | | | 44 | - | annular ring |
| 16 | - | cylindrical base | 46 | - | outlet |
| 17 | - | shoulder | | | |
| 18, 19 | } | pair of arms | | | |
| 20 | - | spring | | | |
| 21, 21 a | } | slots | | | |
| 22 | - | compression spring | | | |
| 23, 24 | } | holes | | | |
| 25 | - | top portion of member 10 | | | |
| 26, 27 | } | slots | | | |
| 28, 29 | } | portions of top portion 25 | | | |
| 30, 31 | } | bars of locking lever | | | |
| 32, 33 | } | pivot screws | | | |
| 34, 35 | } | holes in bars 30, 31 | | | |
| 36, 37 | } | end portions of lever | | | |

What I claim is:

1. A plug release mechanism comprising:

(i) a reciprocatable member having an open end and an end wall closing the opposite end, said member being movable between a locked position and a released position;

(ii) a tubular member in the reciprocatable member and coaxial therewith, the inside end of the tubular member being adapted to have mounted thereon an electric plug having terminal prongs thereon and said inner member being mounted for movement with the reciprocatable member between said locked and released positions;

(iii) a stationary member mounted within the reciprocatable member and coaxial therewith, said stationary member being positioned between the inner member and the reciprocatable member, said stationary member having an elongated extension projecting outwardly through an orifice formed through the end wall of the reciprocatable member;

(iv) a spring acting between the reciprocatable member and the stationary member; and (v) a lever pivotally mounted on the extension, the fulcrum of the lever being located between the end wall and the projecting end of the extension whereby, with the lever coaxial with the reciprocatable member, one end of the lever engages the end wall and holds the inner member in a locked position with the spring under compression so that when the lever is released from the locked position, the inner member is actuated to the released position with the terminal prongs being moved to a position within the stationary member.

2. An electric plug release mechanism according to claim 1 in which the spring is mounted within the reciprocatable member between the end wall thereof and a shoulder formed on the stationary member.

3. An electric plug release mechanism according to claim 1 including means mounting the lever for relative rotative movement about an axis perpendicular to the movement axis of the reciprocatable member.

4. An electric plug release mechanism comprising:

(i) a reciprocatable cylindrical member having an end wall at one end and being open at the other end, said member being movable between a locked position and a released position;

(ii) an inner tubular member depending from the end wall of the reciprocatable member and coaxial therewith, the inside end of the tubular member adapted to have mounted thereon an electric plug having terminal prongs thereon;

(iii) a cylindrical stationary member mounted within the reciprocatable member and coaxial therewith, said stationary member being positioned between the inner tubular member and the outer wall of the reciprocatable member, said stationary member having a pair of elongated arms projecting outwardly through orifices formed through the end wall of the reciprocatable member;

(iv) a spring acting between the reciprocatable member and the stationary member; and (v) a lever pivotally mounted on the arms, the fulcrum of the lever being located between the end wall and the projecting ends of the arms, whereby with the lever coaxial with the reciprocatable member, one end of the lever engages the end wall and holds the reciprocatable member in a locked position with the spring under compression so that when the lever is released from the locked position, the reciprocatable member is actuated to the release position.

5. An electric plug release according to claim 4 having a sleeve pivotally mounted on said arms adjacent the opposite end of the arms.

* * * * *